US006371595B1

(12) United States Patent
Takemoto et al.

(10) Patent No.: US 6,371,595 B1
(45) Date of Patent: Apr. 16, 2002

(54) INK JET PRINTER

(75) Inventors: Takatoshi Takemoto; Yoshiki Katayama, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/405,006

(22) Filed: Sep. 27, 1999

(30) Foreign Application Priority Data

Sep. 19, 1998 (JP) ..... 10-274030
Sep. 28, 1998 (JP) ..... 10-274035

(51) Int. Cl.[7] ..... B41J 2/165
(52) U.S. Cl. ..... 347/33; 347/29; 347/30; 347/32
(58) Field of Search ..... 347/33, 29, 32, 347/22, 30, 23, 14; 15/250.361

(56) References Cited

U.S. PATENT DOCUMENTS 5,440,331 A * 8/1995 Grange ..... 347/33
5,793,391 A * 8/1998 Kawakami et al. ..... 347/33

FOREIGN PATENT DOCUMENTS

| | | |
|---|---|---|
| JP | A-7-52396 | 2/1995 |
| JP | A-8-207293 | 8/1996 |
| JP | A-8-224866 | 9/1996 |

* cited by examiner

*Primary Examiner*—N. Le
*Assistant Examiner*—Shih-wen Hsieh
(74) *Attorney, Agent, or Firm*—Oliff & Berridge, PLC

(57) ABSTRACT

The invention provides an ink jet printer, for example, having a tiny protrusion provided on a blade holder for holding a wiper blade at the side opposite to that cap, a coil spring for pulling the blade holder downwardly in a slanting direction toward where the tiny protrusion is provided, and a wiper raising arm raised together with the cap, for raising the wiper blade by contacting the lower surface of the blade holder, and a base for receiving the tiny protrusion on the upper surface thereof when the blade holder is lowered from the most raised position. Therefore, the wiper blade is stopped at the ink wiping position.

30 Claims, 15 Drawing Sheets

INK JET PRINTER

BACKGROUND OF THE INVENTION

1. Field of Invention

The invention is related to an ink jet printer that performs a wiping operation to wipe ink adhered to an ink ejecting surface of an ink jet print head.

2. Description of Related Art

There are known ink jet printer having a wiper blade for wiping ink adhered to an ink ejecting surface of an ink jet print head. Some conventional ink jet printers have a fixed type of the wiper blade fixed to a position and which wipes ink off the ink ejecting surface of the ink jet print head every time the head reciprocatingly moves inside the printer. In such ink jet printers having the fixed type of wiper blade, the wiping operation is performed every time the ink jet print head reciprocatingly moves inside the printer. Therefore, the durability of the wiper blade is decreased.

To solve the above-described problem, an ink jet printer having a wiper blade that moves up and down between an ink wiping position and a standby position, is provided so that the wiping operation is performed as necessary. For example, ink jet printers disclosed in Japanese Unexamined Patent Publication No. 8-207293 and Japanese Unexamined Patent Publication No. 8-224866, have a lever provided for a wiper blade. The wiper blade is raised and lowered by the lever operated by the reciprocating movement of a carriage.

The ink jet printer disclosed in Japanese Unexamined Patent Publication No. 7-52396 has a cam mechanism only for raising and lowering a wiper blade. The wiper blade is raised and lowered by the drive power transmitted from a line feed motor to the cam mechanism.

However, in the above-described prior art employing the mechanism of raising and lowering the wiper blade with the reciprocating movement of the carriage, parts such as levers for raising and lowering the wiper blade need to be provided, leading to a complicated mechanism for raising and lowering the wiper blade and an increased number of parts to be used. In addition, the motor torque of the carriage motor is increased due to the greater loads applied.

In the above-described prior art employing the mechanism of raising and lowering the wiper blade with the cam mechanism driven by the line feed motor, the cam mechanism leads to the complicated structure for raising and lowering the wiper blade and an increased number of parts to be used.

Further, known ink jet printers have a wiper blade formed from elastic materials, such as rubber, and ink is wiped off an ink ejecting surface by contacting the wiper blade to the ink ejecting surface of an ink jet print head while moving the head. However, in such ink jet printers as constructed above, the ink is scattered around in a printer by the wiper blade sprung back from the bent state to the original state due to its elasticity after wiping all ink ejecting surfaces. Consequently, the inside of the printer is soiled with the ink.

SUMMARY OF THE INVENTION

Accordingly, one aspect of the invention is to provide an ink jet printer having a simple mechanism of raising and lowering a wiper blade without causing an increase in motor torque. Another aspect of the invention is to provide an ink jet printer having a wiping mechanism by which ink wiped off an ink ejecting surface of an ink jet print head by the wiper blade during a wiping operation, will not be scattered around in the printer.

In accordance with the invention, there is provided an ink jet printer having a purge cap for covering an ink ejecting surface of an ink jet print head and sucking the ink therefrom to perform purging, and a wiper blade for wiping the ink adhered to the ink ejecting surface purged by the purge cap. The ink jet printer includes ablade holder that holds the wiper blade and has a tiny protrusion to a side opposite to a side facing to the purge cap, an urging/pulling device that urges/pulls the blade holder in the direction that the tiny protrusion is provided and the direction of the initial position where the edge of the wiper blade does not make contact with the ink ejecting surface, a wiper moving member that moves the wiper blade to an ink wiping position where the wiper blade makes contact with the ink ejecting surface by being engaged with or contacting to a portion of the blade holder according to the reciprocating movement between a first position where the purge cap stays farthest away from the ink ejecting surface and a second position where the purge cap stays closest to the ink ejecting surface and the purging is performed, and a base that receives the tiny protrusion of the blade holder against the urging force by the urging/pulling device so that the wiper blade is kept at the ink wiping position, wherein the blade holder is moved so that the edge of the wiper blade reaches the ink wiping position using a cap moving mechanism that moves the purge cap from the first position to the second position, and the wiper blade is returned to the initial position by the urging/pulling device as the tiny protrusion is taken off from the base by the ink jet print head moved in a direction opposite to a direction that the ink is wiped by the wiper blade.

In the ink jet printer of the invention, as the purge caps are moved from the first position to the second position to suck ink from the ink ejecting surface of the ink jet print head for purging, the wiper moving member is also moved and is engaged with or contacts the blade holder, thereby moving the blade holder to the ink wiping position. After purging, when the purge cap is returned to the first position, the wiper blade also starts to return to the initial position. However, the tiny protrusions provided on the side surface of the blade holder are received by the base and the blade holder stays at the ink wiping position. In this state, the ink jet print head is moved in a direction so that head makes contact with the wiper blade to wipe the ink adhered on the ink ejecting surface. Thus, the wiping operation is performed. Thereafter, when the ink jet print head is moved in the opposite direction, the wiper blade is pushed by the ink jet print head and moved in the direction so that the tiny protrusions are removed from the base. Consequently, the wiper blade is returned to the initial position by the urging/pulling device.

As described above, in the ink jet printer of the invention, the wiper blade is moved to the ink wiping position as linked with the purge operation. As the ink jet print head is moved in the direction opposite to that the wiper blade is moved during the wiping operation, after the ink is wiped off the ink ejecting surface, the wiper blade is returned to the initial position. The force to be applied to make the wiper blade return to the initial position, is just enough force to remove the tiny protrusion from the base, and so that an increase in the motor torque of the carriage motor will not occur.

The ink jet printer of the invention includes a tiny protrusion provided on a side surface of a blade holder that holds the wiper blade and an opposite side facing the purge cap, a pulling member that pulls the blade holder downwardly in a slanting direction that the tiny protrusion are provided, a wiper raising member that raises the blade holder by contacting to the lower surface of the blade holder according to the upward movement of the purge cap toward the ink jet print head, and a base that receives on the upper surface thereof the tiny protrusion to stop the blade holder raised toward the ink jet print head by the wiper raising member at a raised position, wherein the base receives the tiny protrusion when the blade holder is lowered, and stops the wiper blade at an ink wiping position (on the ink ejecting surface).

As the purge caps are raised to suck the ink from the ink ejecting surface for purging, the wiper raising member is also raised. When the purge cap is lowered after purging, the wiper raising member is also lowered, and the blade holder starts to lower its position. However, since the blade holder is being pulled by the pulling member downwardly in the slanting direction that the base is provided, the tiny protrusion provided on a side surface of the blade holder is received by the base, stopping the blade holder at the ink wiping position. In this state, the ink jet print head is moved in a direction so that the head makes contact with the wiper blade to wipe the ink adhered on the ink ejecting surface. Thus, the wiping operation is performed. Thereafter, when the ink jet print head is moved in the opposite direction, the wiper blade is pushed by the ink jet print head and is moved in the direction such that the tiny protrusions are taken off from the base. Consequently, the wiper blade is pulled downwardly by the pulling member and is returned to the initial position.

In the ink jet printer of the invention, the wiper blade is raised to the ink wiping position as it is necessary. After the ink is wiped off the ink ejecting surface, the wiper blade is returned to the initial position by moving the ink jet print head in the direction opposite to that in which the wiper blade is moved during the wiping operation. The force to be applied to make the wiper blade return to the initial position, is just enough force to take off the tiny protrusion from the base, and an increase in the motor torque of the carriage motor will not occur. Only by providing the tiny protrusions on the blade holder, the pulling member, and the base, one aspect of the invention can be achieved with simple structure and with the small number of parts.

In the ink jet printer of the invention, the purge cap and the wiper raising member are raised by a cam mechanism driven by a line feed motor for paper feeding.

By the cam mechanism driven by the line feed motor, the purge cap is raised and lowered, and the wiper blade is raised. Only by providing the wiper raising member, the above-described movement can be performed. One aspect of the invention can be achieved with the simple mechanism without the number of parts increased.

In accordance with the invention, there is provided an ink jet printer having a purge cap for covering an ink ejecting surface of an ink jet print head and sucking ink therefrom to perform purging, and a wiper blade for wiping the ink adhered to the ink ejecting surface purged by the purge cap. The ink jet printer of the invention includes a wiper blade movable up and down between an upward ink wiping position and a downward initial position for wiping the ink adhered to the ink ejecting surface by the wiper blade, and a relative movement mechanism that relatively moves the ink jet print head and the wiper blade in an ink wiping direction, with the wiper blade raised to the ink wiping position and contacting to the ink ejecting surface. The relative movement mechanism stops the relative movement of the ink jet print head and the wiper blade immediately before the wiper blade reaches an edge of the ink ejecting surface, wipes off all areas of the ink ejecting surface, and then lowers the wiper blade to an initial position.

In the ink jet printer of the invention, when the ink adhered on the ink ejecting surface of the ink jet print head is wiped off after purging, an ink wiping operation is stopped immediately before the wiper blade reaches an edge of the ink ejecting surface and wipes off all areas of the ink ejecting surface. Then, the wiper blade is lowered to the initial position. At this time, the wiper blade bent or warped during the ink wiping operation is lowered to the initial position while releasing its bending or warping state. The wiper blade does not scatter the wiped ink due to its elasticity. Therefore, the inside the printer will not be soiled with the ink wiped from the ink ejecting surface scattered around.

An ink jet printer of the invention may further include a tiny protrusion provided on a side surface of a blade holder that holds the wiper blade opposite to a side facing to the purge cap, a pulling member that pulls the blade holder downwardly in a slanting direction where the tiny protrusion is provided, a wiper raising/lowering member that raises or lowers the blade holder by contacting the lower surface of the blade holder according to the raising/lowering movement of the purge cap, a base that receives on the upper surface thereof the tiny protrusion on the way that the blade holder is lowered from the most raised position to stop the wiper blade at the ink wiping position, and a movement mechanism that lowers the purge cap after purging and moves the ink jet print head toward the wiper blade. The movement mechanism stops the ink jet print head immediately before the wiper blade reaches an edge of the ink ejecting surface and wipes off all areas of the ink ejecting surface, and then moves the ink jet print head in an opposite direction.

As the purge caps are raised to suck the ink from the ink ejecting surface for purging, the wiper raising member is also raised. The blade holder is raised by the wiper raising member pushing the lower surface of the blade holder upwardly when the wiper raising member is raised. When the purge cap is lowered after purging, the wiper raising member is also lowered, and the blade holder starts to lower its position. However, since the blade holder is being pulled by the pulling member downwardly in the slanting direction that the base is provided, the tiny protrusion provided on a side surface of the blade holder is received by the base, stopping the blade holder at the ink wiping position. In this state, the ink jet print head is moved in a direction so that the head makes contact with the wiper blade to wipe the ink adhered on the ink ejecting surface using the wiper blade. Thus, the wiping operation is performed. In the ink wiping operation, the ink jet print head movement is stopped immediately before the wiper blade reaches an edge of the ink ejecting surface and wipes off all areas of the ink ejecting surface. The edge of the wiper blade is contacting the ink ejecting surface and the wiper blade remains bent or warped. In this state, the ink wiping operation is finished. Thereafter, the wiper blade is pushed by the ink jet print head and is moved in the direction that the tiny protrusions are taken off from the base. Consequently, the wiper blade is pulled downwardly by the pulling member and is returned to the initial position. When the wiper blade is returned to the initial position, the bending or warping of the blade is removed, so that the wiped ink will not scattered around in the printer by the wiper blade being sprung back due to its elasticity.

The ink jet printer of the invention further includes a stopper member for stopping the ink jet print head right over the purge cap by contacting the ink jet print head. The stopper member is raised and lowered together with the purge cap.

Since the ink jet print heads can be stopped right over the caps by the stopper member, the starting position where the ink jet print heads start to move for the ink wiping operation after purging, can be fixed. Therefore, the ink jet print head can be stopped immediately before the wiper blade reaches an edge of the ink ejecting surface and wipes off all areas of the ink ejecting surface.

Further objects, details, and advantages of the invention will be apparent from the following detailed description, when read in conjunction with the drawings.

BRIEF DESCRIPTION OF THE DRAWINGS

Preferred embodiments of the invention will be described in detail with reference to the following figures wherein.

DETAILED DESCRIPTION OF PREFERRED EMBODIMENTS

Figure 1:
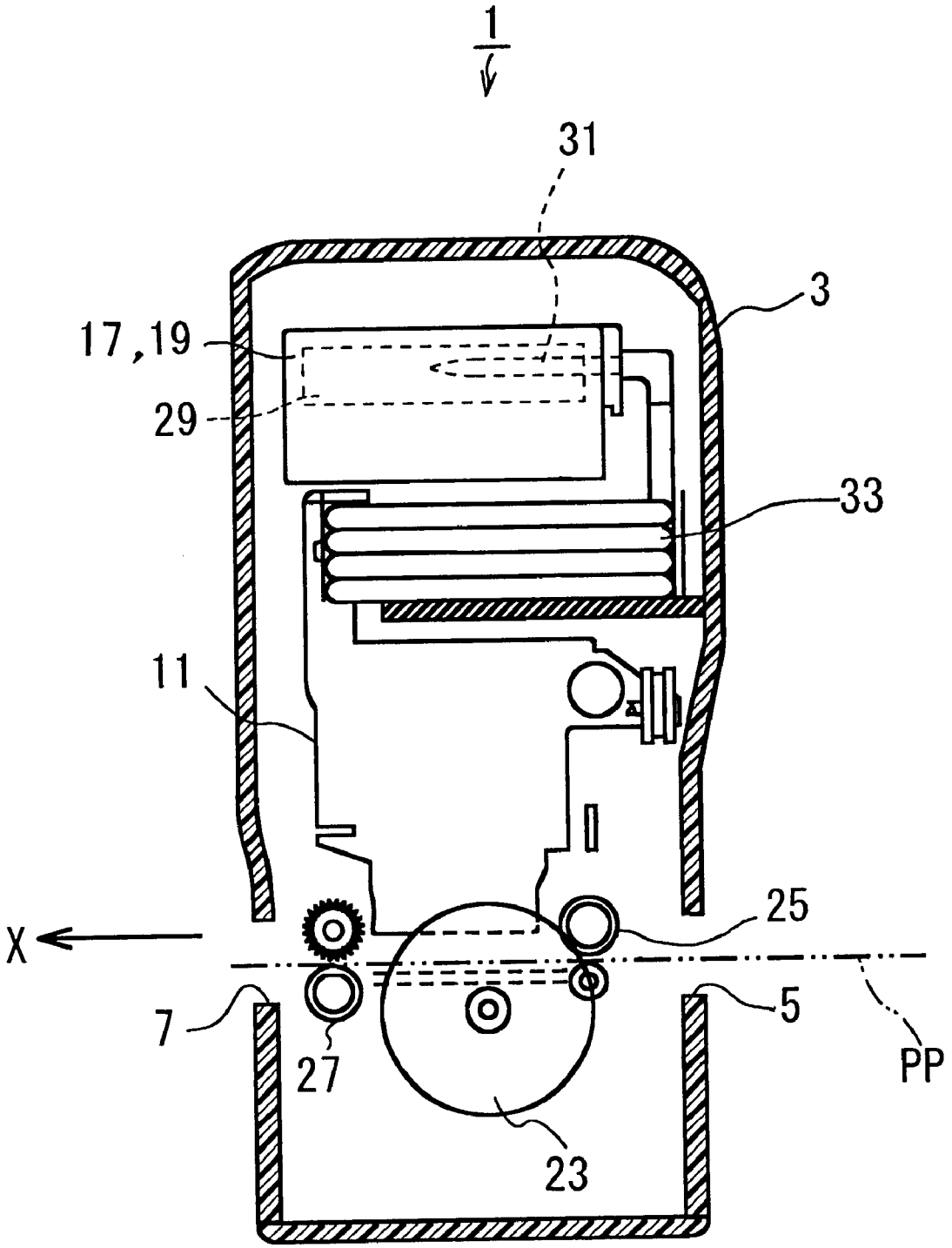
FIG. 1 is a vertical sectional view of a portable printer according to an embodiment of the invention.

A preferred embodiment of the invention will be described with reference to the figures. A portable printer 1 of this embodiment as shown in FIG. 1, has a printer body 3 having an elongated rectangular shape, viewed from the side. Formed in a substantially central portion in a lower rear portion of the printer body 3 is a sheet insert opening 5. A print sheet PP is inserted from the sheet insert opening 5 and discharged out of a sheet discharge opening 7 formed in the front side of the printer body 3, as images are being printed by a printing mechanism inside the printer body 3.

Figure 2:
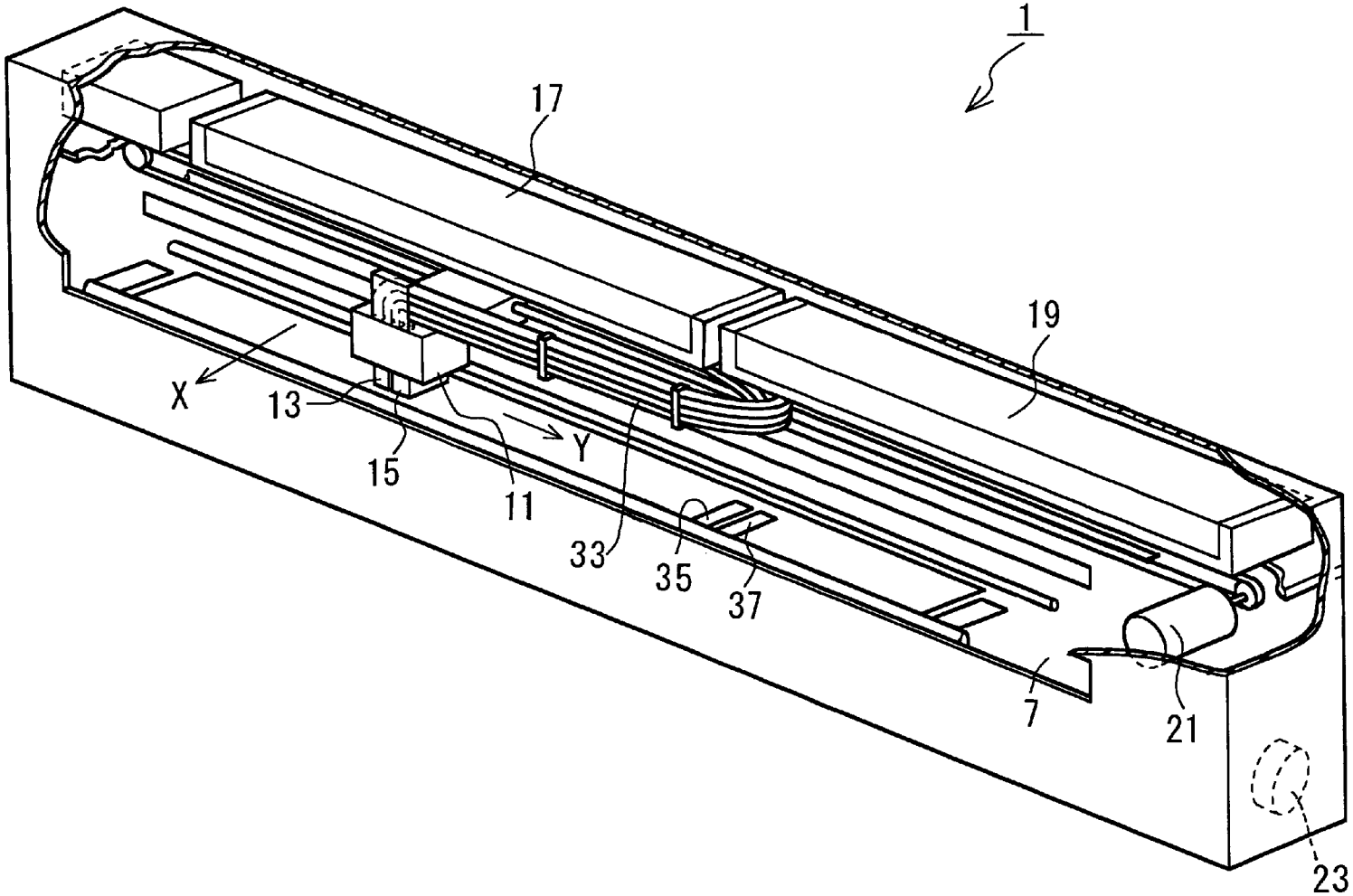
FIG. 2 is a partially cutaway perspective view of the portable printer for schematic illustration of an internal structure of the printer.

As shown in FIGS. 1 and 2, the printing mechanism includes a carriage 11 that reciprocatingly moves within the printer body 3 in the direction of the arrow Y and the opposite direction, ink jet print heads 13, 15 mounted on the carriage 11, ink cartridges 17, 19 detachably disposed on the upper portion of the printer body 3, a carriage motor 21 for driving the carriage 11 in the direction of the arrow Y and the opposite direction, a line feed motor 23 for conveying the print sheet PP in the direction of the arrow X from the rear side to the forward side of the printer body 3, sheet conveying rollers 25, 27 driven by the line feed motor 23, most of which are disposed in the lower portion of the printer body 3 so that the portable printer 1 has a low center of the gravity.

Each of the ink cartridges 17, 19 has two ink bags of an ink package 29 therein. Each ink bag of the ink package 29 housed in the ink cartridge 17 contains the black or magenta ink. Each ink bag of the ink package 29 housed in the ink cartridge 19 contains the yellow or cyan ink.

The ink bag of the ink package 29 is formed by a material obtained by laminating a plurality of film sheets formed from a polyethylene resin. Ink in the ink bag of the ink package 29 is supplied to the ink jet print heads 13, 15 through an ink extracting needle 31 and an ink supply tube 33.

As shown in FIG. 2, the portable printer 1 of this embodiment has caps 35, 37 that cover the ink jet print heads 13, 15 to prevent the ink jet print heads 13, 15 from drying when the portably printer 1 is unoperated. Of the caps 35, 37, the cap 35 disposed in the left side in FIG. 2 is also used as a purge cap that performs purging of sucking the ink from the ink jet print heads 13, 15 by a suction pump 51 (described below).

Figure 3:
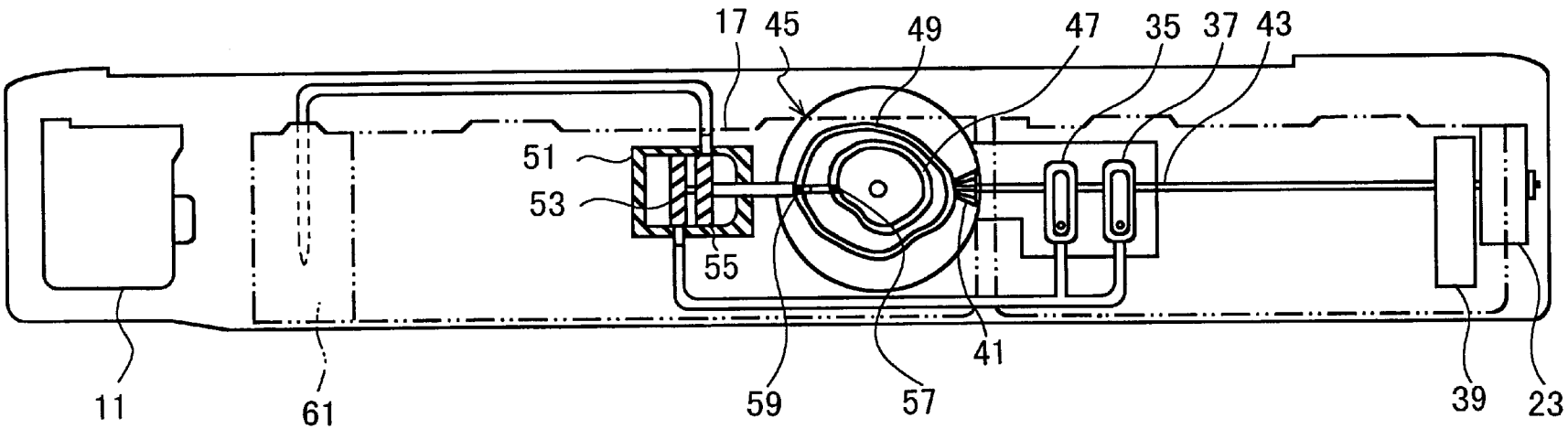
FIG. 3 is a plan sectional view of the portable printer for schematic illustration of an internal structure of the printer.
Figure 4:
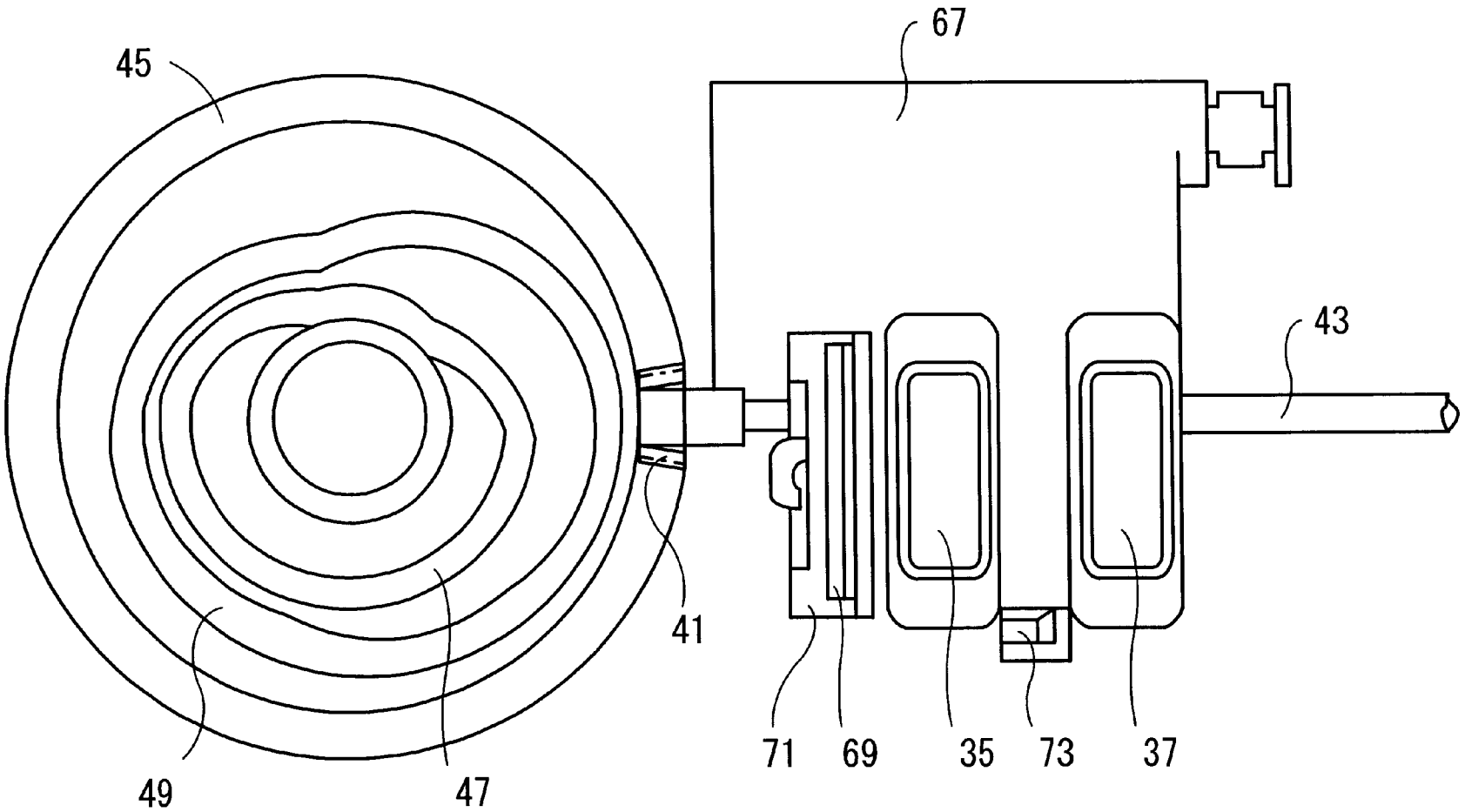
FIG. 4 is a plan enlarged view of caps and a wiper blade of the portable printer.

For purging, as shown in FIGS. 3 and 4, drive power is transmitted from the line feed motor gear 23 to a driving shaft 43 via a connecting mechanism 39 comprised of a gear and a clutch. Drive power is then transmitted from the driving shaft 43 to the maintenance cam 45 via a bevel gear 41 provided on a distal end of the driving shaft 43, so that the maintenance cam 45 is rotated. More specifically, the distal ends of rods 57, 59 extending from two pistons 53, 55 of the suction pump 51 are engaged with an inner and outer grooves 47, 49 formed on the upper surface of the maintenance cam 45. While the maintenance cam 45 rotates once, a negative pressure occurs in the cap 35. Then the ink is sucked and discharged into a waste ink reservoir 61 of the ink cartridge 17. The rod 59 of the piston 55 disposed closer to the maintenance cam 45, is a hollow tubular rod and the rod 57 of the piston 53 is inserted into the hollow tubular rod 59 and can freely slide therein.

Figure 5:
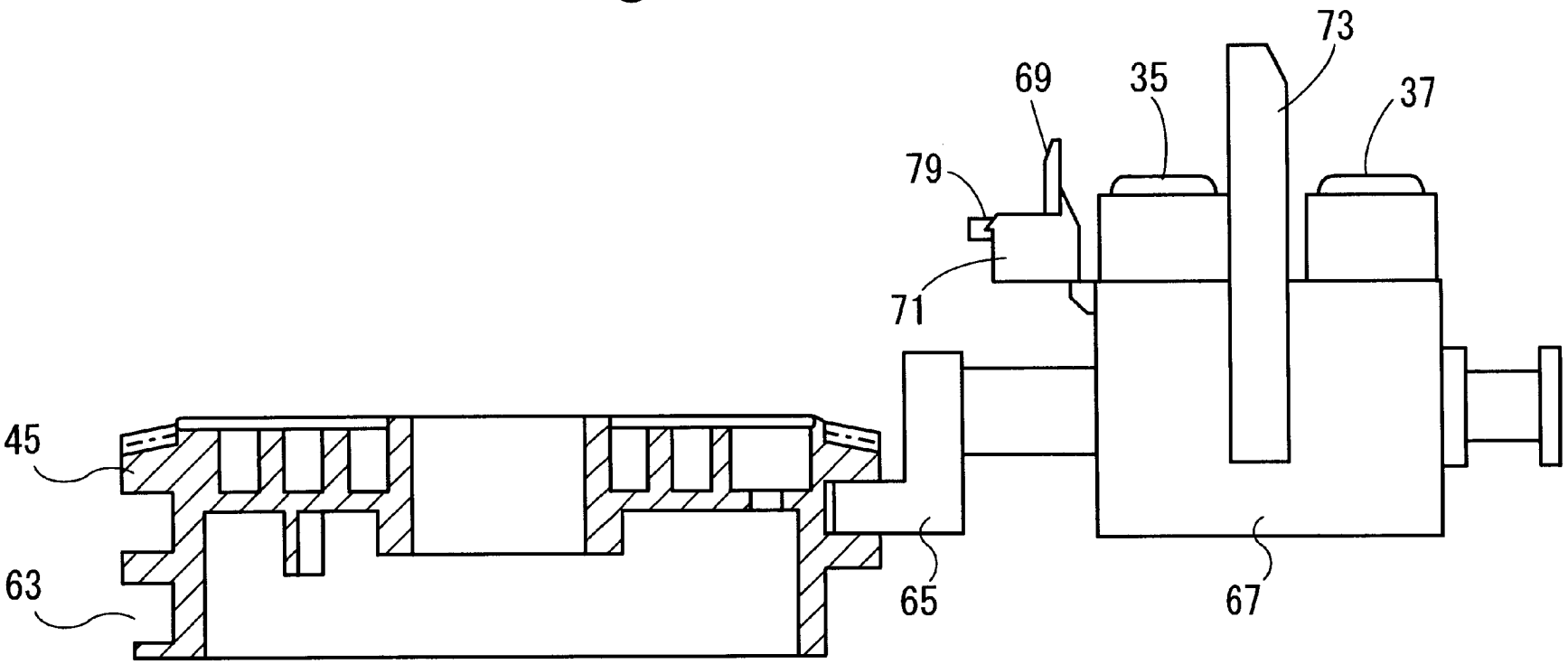
FIG. 5 is a front enlarged view of the caps and the wiper blade of the portable printer.
Figure 6A:
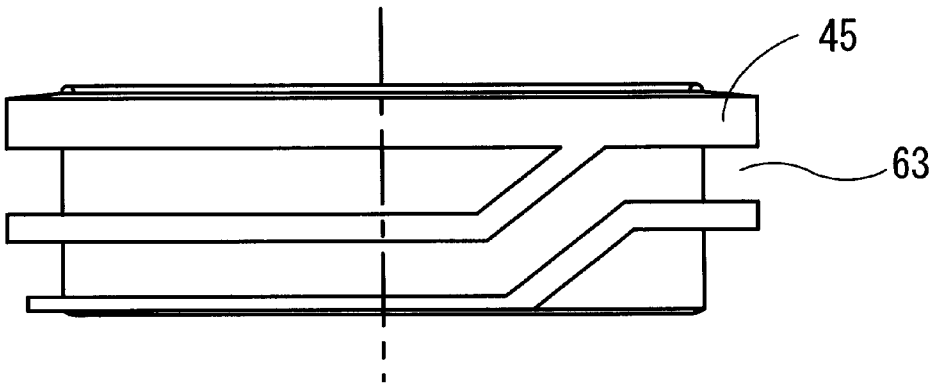
FIG. 6A is a side view of a maintenance cam of the portable printer.
Figure 6B:
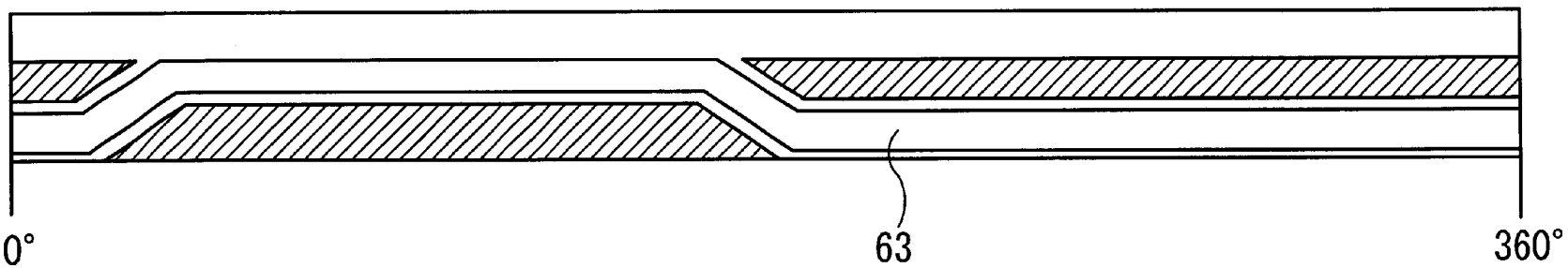
FIG. 6B is a development of the maintenance cam.

As shown in FIGS. 5, 6A and 6B the maintenance cam 45 also has a cam groove 63 on the side surface thereof. Into the cam groove 63, a cam follower 65 provided on a cap driving lever 67 which has the caps 35, 37, is engaged. While the maintenance cam 45 rotates once, the caps 35, 37 are moved from the lowered position to the raised position and then back to the lowered position, according to the raising and lowering movements of the cap driving lever 67. The ink is sucked for purging when the caps 35, 37 are in the raised position.

As shown in FIGS. 4 and 5, a wiper blade 69 for removing ink or the like adhered on the ink ejecting surface of the ink jet print heads 13, 15, is disposed at the left side of the cap 35. The wiper blade 69 is raised from the lowered position to the raised position by a blade holder 71 raised when the cap driving lever 67 raises.

As shown in FIGS. 4 and 5, the cap driving lever 67 has a stopper 73 between the cap 35 and the cap 37 for positioning the carriage 11.

Figure 7A:
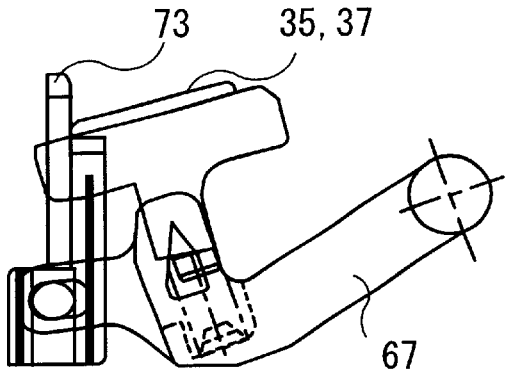
FIGS. 7A–7F are side views of the caps, the wiper blade, and a stopper of the portable printer, illustrating the state when they are raised and lowered.
Figure 7B:
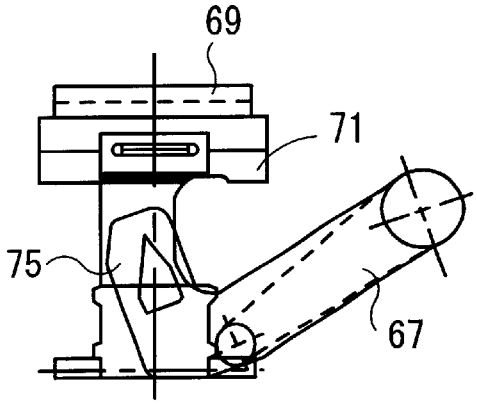

The raising and lowering movements of the caps 35, 37, the wiper blade 69, and the stopper 73 will be described with reference to FIGS. 7A and 7B. FIGS. 7A and 7B show the state that the caps 35, 37, the wiper blade 69, and the stopper 73 are in the lowered positions. In this state, a wiper raising arm 75 provided on the cap driving lever 67 as a wiper moving member or a wiper raising member does not make contact with the blade holder 71.

Figure 7C:
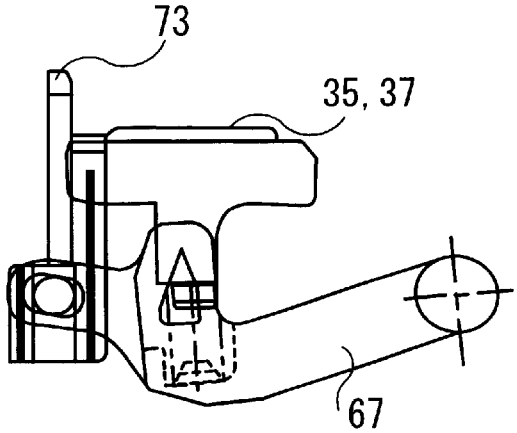
Figure 7D:
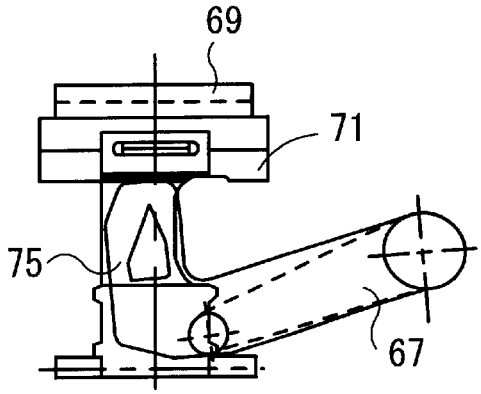
Figure 7E:
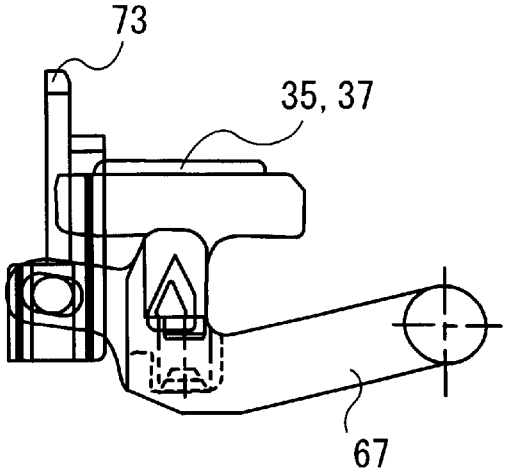
Figure 7F:
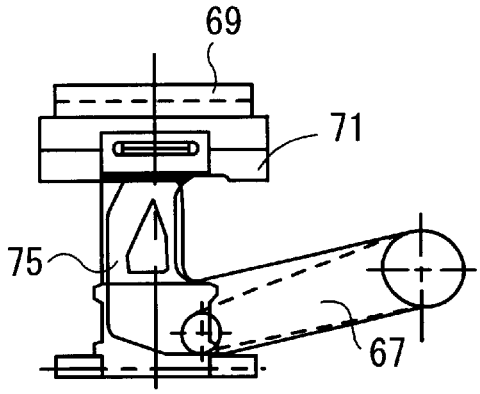
Figure 8B:
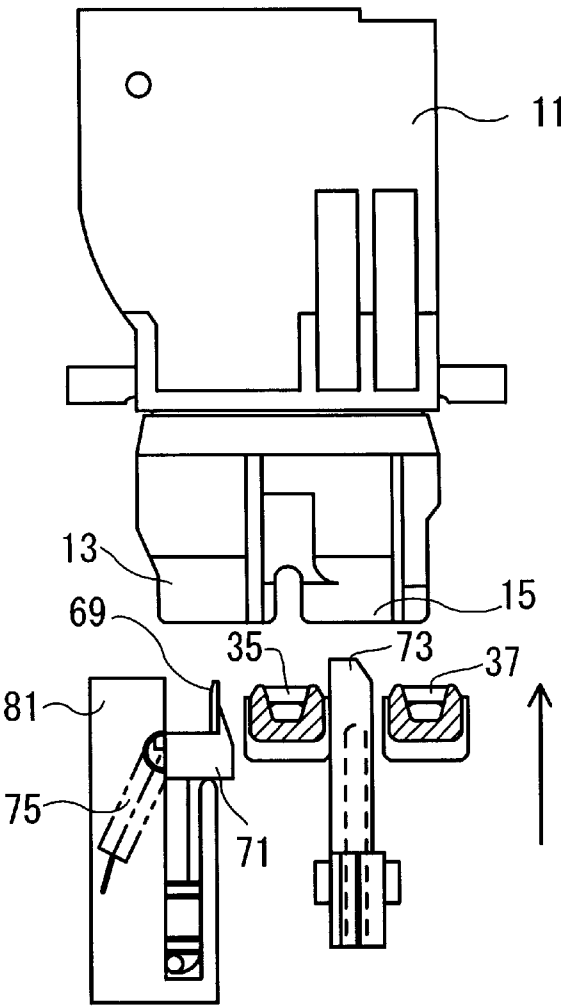
FIGS. 8A and 8B are front views of the carriage, the caps, the wiper blade, and the stopper of the portable printer, illustrating their movements when the purge operation for a left-side ink jet print head is performed.
Figure 8A:
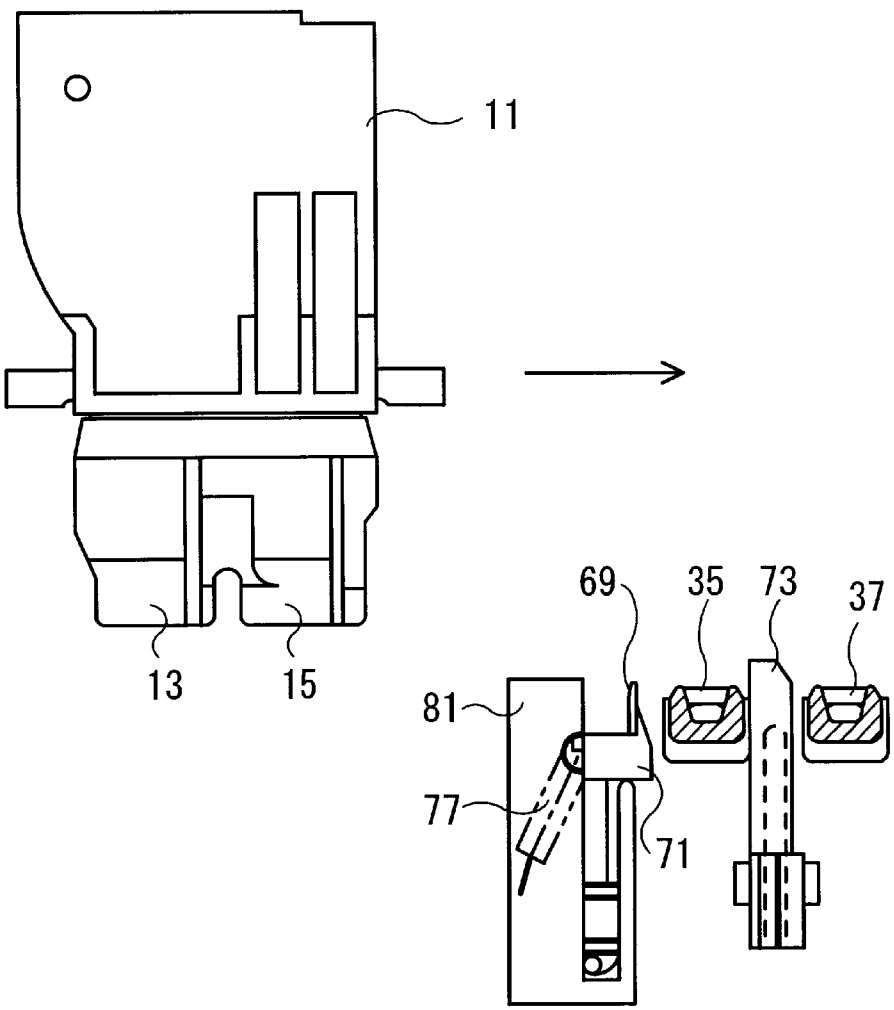
Figure 9B:
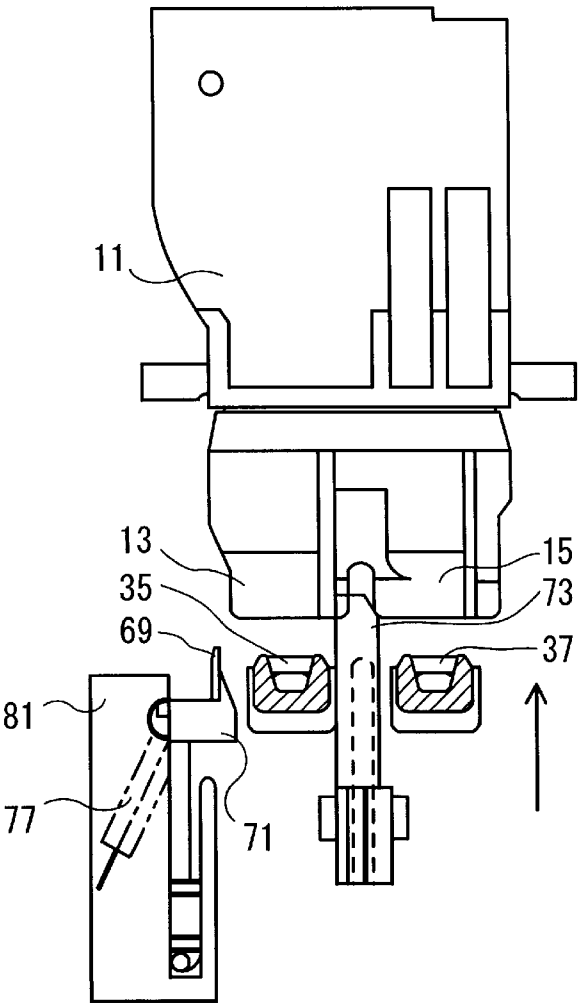
FIGS. 9A and 9B are front views of the carriage, the caps, the wiper blade, and the stopper of the portable printer, illustrating their movements when the purge operation for the left-side in jet print head is performed.
Figure 9A:
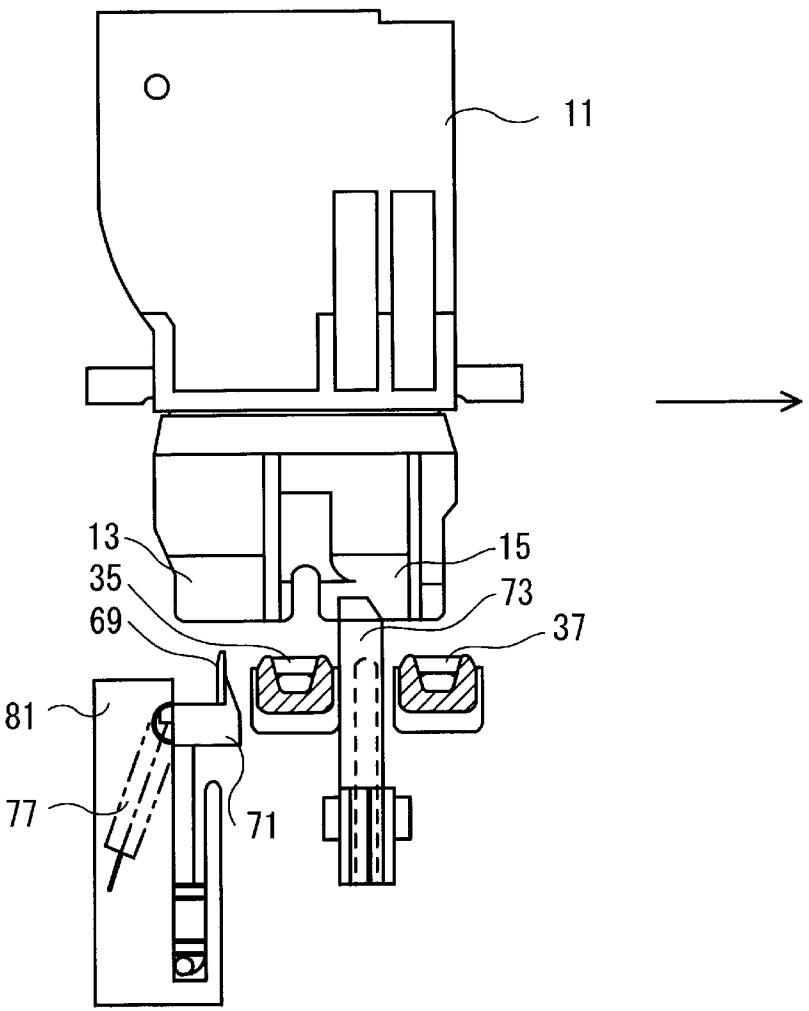

When the maintenance cam 45 starts to rotate, the cap driving lever 67 starts to be raised, and the caps, 35, 37 and the stopper 73 are raised accordingly, as shown in FIG. 7C. As shown in FIG. 7D, as the caps 35, 37 and the stopper 73 are raised according to the raising movement of the cap driving lever 67, the wiper raising arm 75 makes contact with the lower surface of the blade holder 71. As shown in FIGS. 7E and 7F, as the maintenance cam 45 continuously rotates, the caps 35, 37 and the stopper 73 are raised further up. The wiper blade 69 is also raised by the wiper raising arm 75 pushing the blade holder 71 upwardly.

With reference to FIGS. 8A to 11B, the raising and lowering movements of the caps 35, 37, the wiper blade 69, and the stopper 73, when the purge operation for the left-side ink jet print head 13 is performed, are described along with the movement of the carriage 11. As shown by an arrow in FIG. 8A, the carriage 11 is moved near the caps 35, 37 before starting the purge operation. Then, as shown by an arrow in FIG. 8B, the caps 35, 37, the wiper blade 69, and the stopper 73 are raised. As shown by an arrow in FIG. 9A, the carriage 1 is moved to the right side after the stopper 73 is raised to the predetermined position, so that the left-side ink jet print head 13 makes contact with the stopper 73, as shown in FIG. 9B. Then, the caps 35, 37, the wiper blade 69, and the stopper 73 are raised as shown by an arrow in FIG. 9B.

Figure 10B:
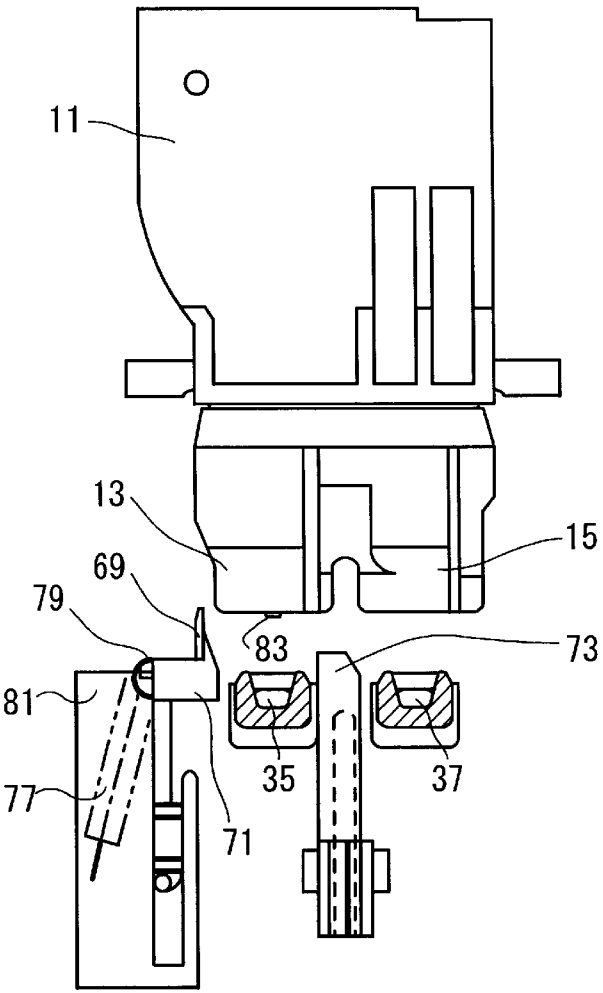
FIGS. 10A and 10B are front views of the carriage, the caps, the wiper blade, and the stopper of the portable printer, illustrating their movements when the purge operation for the left-side ink jet print head is performed.
Figure 10A:
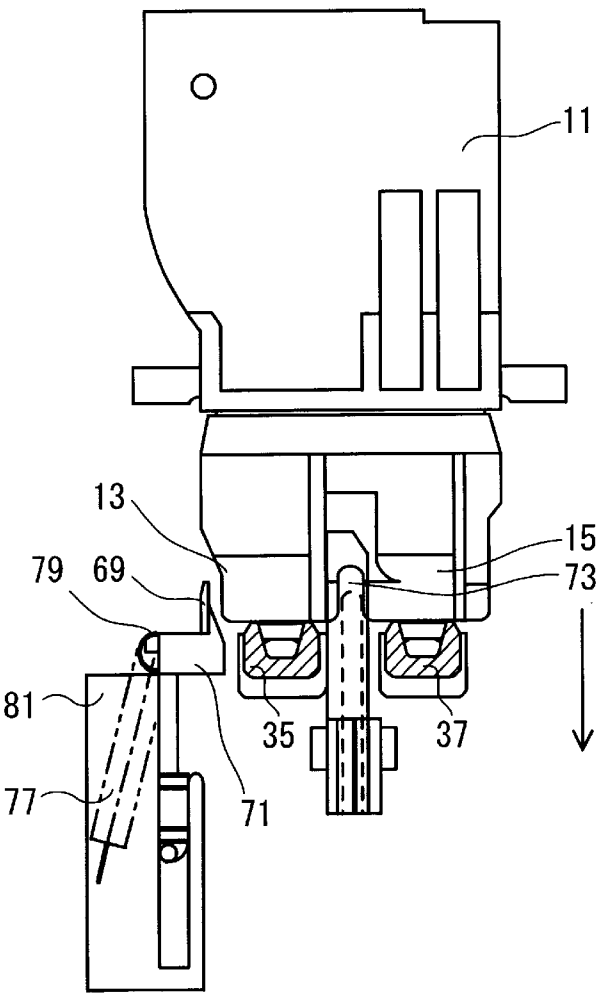

As shown in FIG. 10A, the ink ejecting surfaces of the ink jet print heads 13, 15 are covered with the caps 35, 37 when the caps 35, 37, the wiper blade 69, and the stopper 73 are at the most raised positions. In this state, the suction pump 51 sucks the ink from the left-side ink jet print head 13 as described above, thus the purge operation is performed for the left-side ink jet print head 13.

As the maintenance cam 45 starts to rotate after purging, the caps 35, 37 and the stopper 73 are lowered to their initial positions, as shown in FIG. 10B. The wiper blade 69 also starts to be lowered, by being pulled downwardly to the left-side by a coil spring 77 of an urging device or a pulling member. The caps 35, 37 and the stopper 73 simultaneously start to be lowered. However, tiny protrusions 79 provided at the left side surface of the blade holder 71, contact and are received by the upper surface of abase 81 on the way that the wiper blade 69 is lowered, stopping the blade holder 71 from moving down. Therefore, the wiper blade 69 at this time is not lowered to the initial position but stays raised, as shown in FIG. 10B.

Figure 11B:
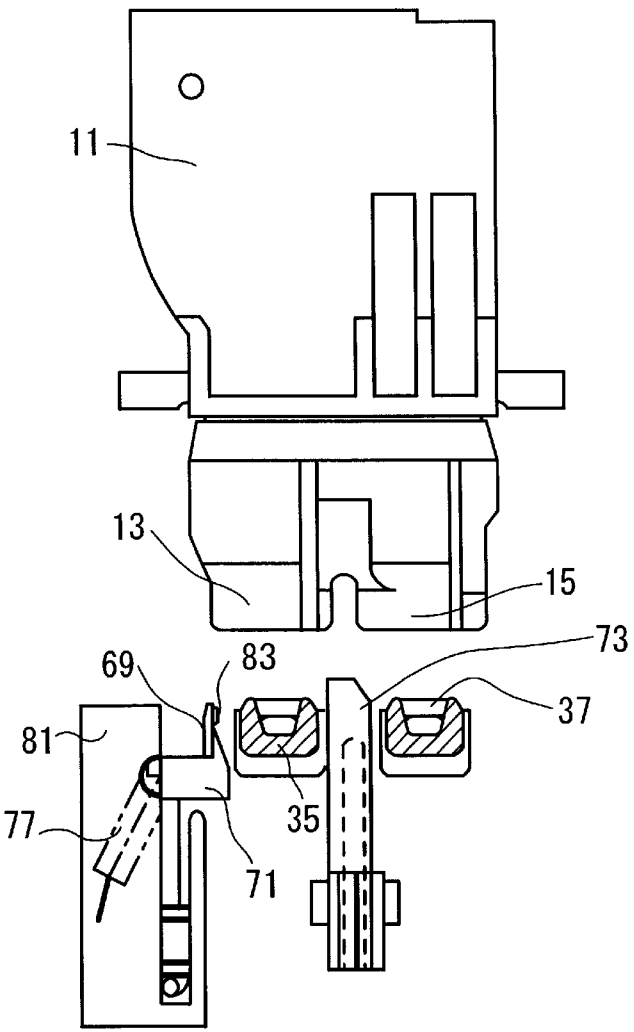
FIGS. 11A and 11B are front views of the carriage, the caps, the wiper blade, and the stopper of the portable printer, illustrating their movements when the purge operation for the left-side ink jet print head is performed.
Figure 11A:
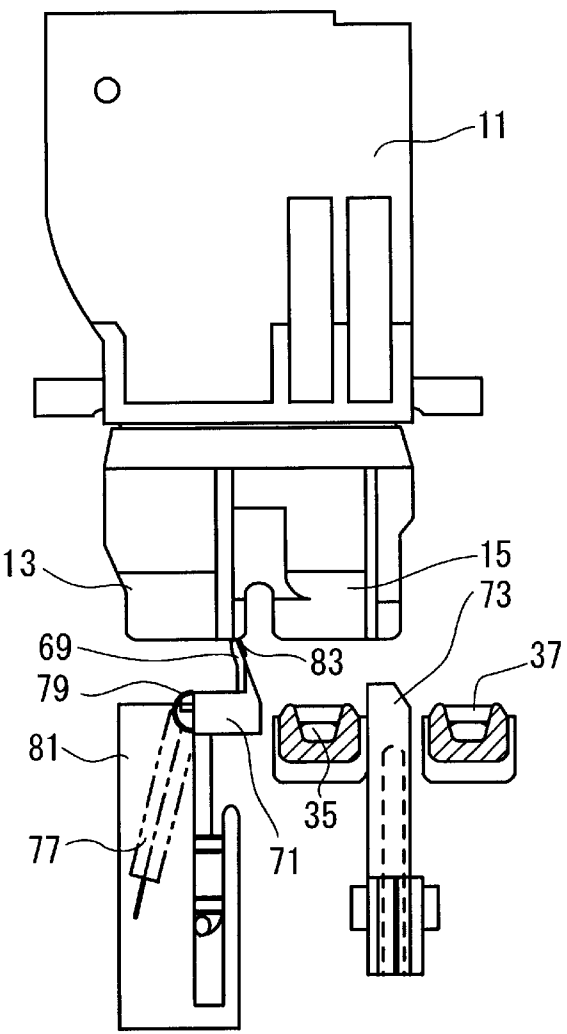
Figure 12B:
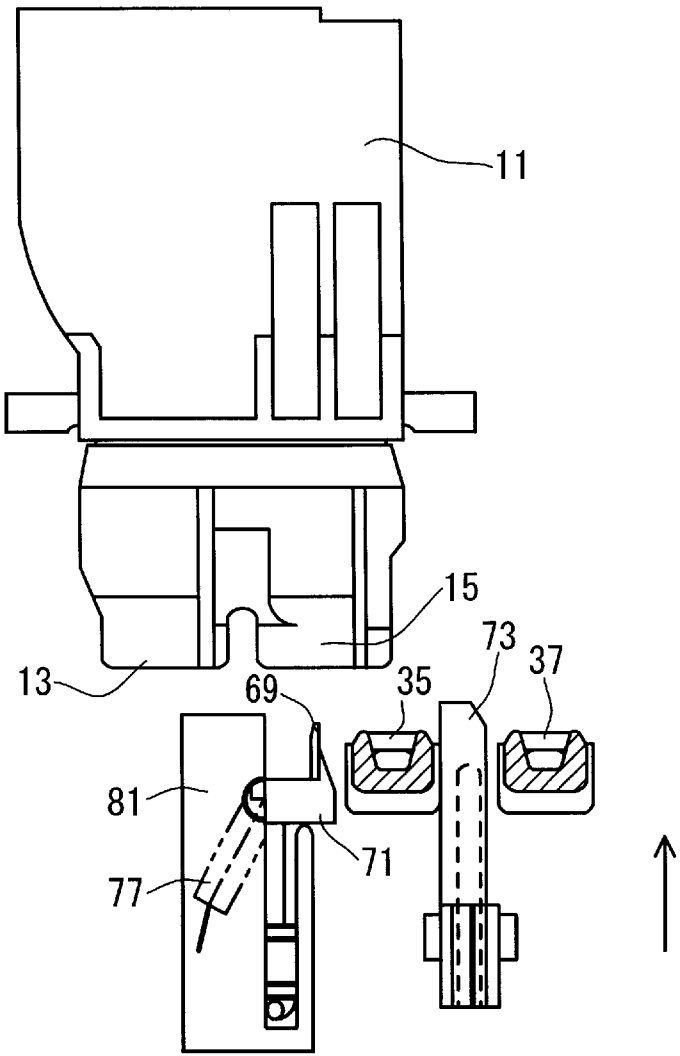
FIGS. 12A and 12B are front views of the carriage, the caps, the wiper blade, and he stopper of the portable printer, illustrating their movements when the purge operation for a right-side ink jet print head is performed.
Figure 12A:
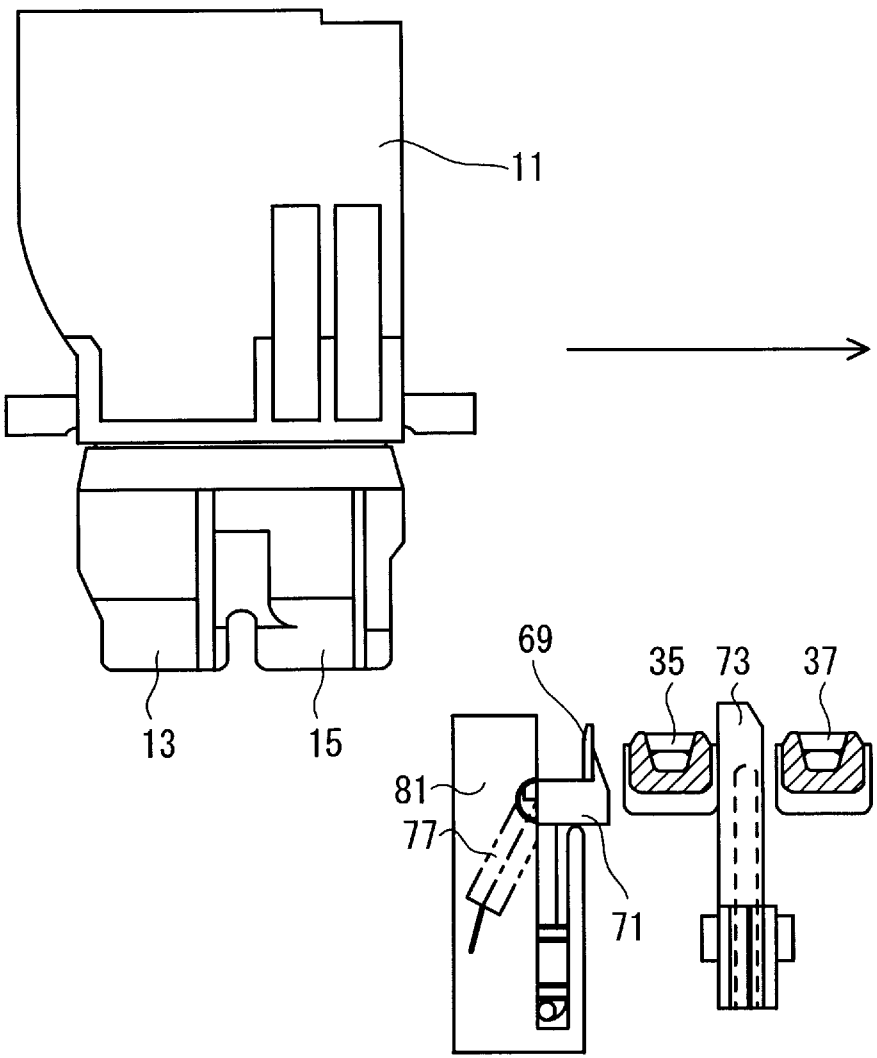
Figure 13B:
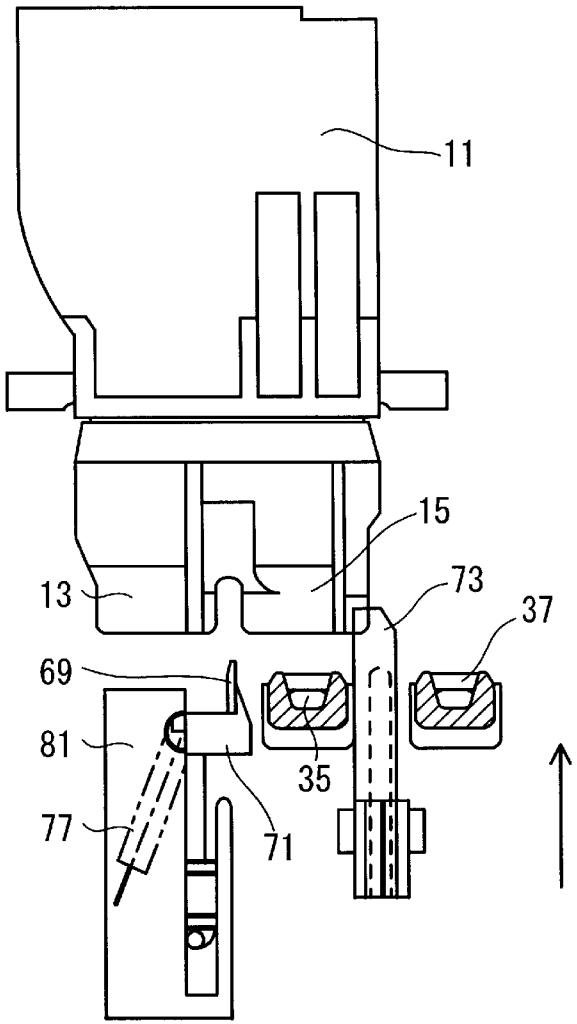
FIGS. 13A and 13B are front views of the carriage, the caps, the wiper blade, and the stopper of the portable printer, illustrating their movements when the purge operation for the right-side ink jet print head is performed.
Figure 13A:
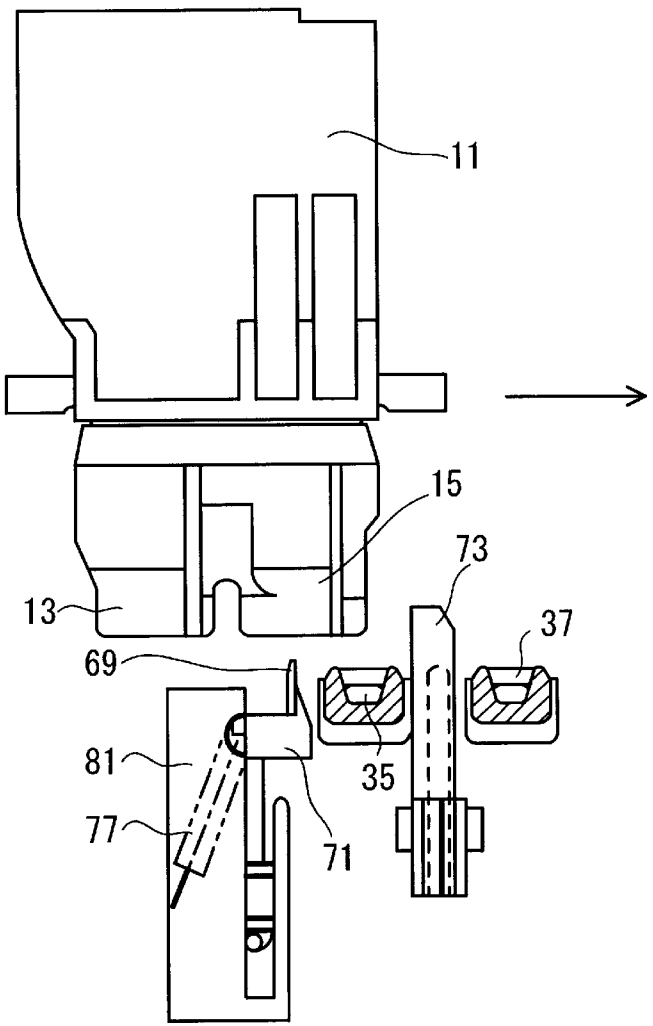

In this state, when the carriage 11 is moved to the left side, as shown by an arrow in FIG. 10B, the wiper blade 69 kept raised by the base 81, starts to wipe off ink 83 remaining on the ink ejecting surface of the left-side ink jet print head 13 after purging. As shown in FIG. 11A, the carriage 11 is stopped after moving to the left side by the predetermined amounts before the wiper blade 69 reaches the edge of the ink ejecting surface of the left-side ink jet print head 13 and wipes off all the areas of the ink ejecting surface. At this time, the edge of the wiper blade 69 remains in contact with the ink ejecting surface of the left-side ink jet print head 13 with the wiper blade 69 kept bent or warped as the same as when the wiping operation is performed. The ink 83 wiped by the wiper blade 69 falls down on the bent or warped wiper blade 69, so that the ink 83 will not be scattered around in the printer.

Thereafter, as shown in FIG. 11A, the carriage 11 is moved to the right side. The blade holder 71 kept raised by the tiny protrusions 79 and the base 81, is pushed to the right side together with the wiper blade 69 by the left-side ink jet print head 13, and the tiny protrusions 79 are off from the base 81. At this time, the blade holder 71 is lowered and returned to the initial position as shown in FIG. 11B, since the blade holder 71 is pulled downwardly to the left-side by the coil spring 77.

With reference to FIGS. 12A to 15B, the raising and lowering movements of the caps 35, 37, the wiper blade 69, and the stopper 73, when the purge operation for the right-side ink jet print 15, are described along with the movement of the carriage 11. Similar to the purge operation for the left-side ink jet print head 13, the carriage 11 is moved near the caps 35, 37 as shown by an arrow in FIG. 12A, before starting the purge operation. Then, as shown by an arrow in FIG. 12B, the caps 35, 37, the wiper blade 69, and the stopper 73 are raised. As shown by an arrow in FIG. 13A, the carriage 11 is moved to the right side after the stopper 73 is raised to the predetermined position, so that the right-side ink jet print head 15 makes contact with the stopper 73, as shown in FIG. 13B. Then, the caps 35, 37, the wiper blade 69, and the stopper 73 are raised as shown by an arrow in FIG. 13B.

Figure 14B:
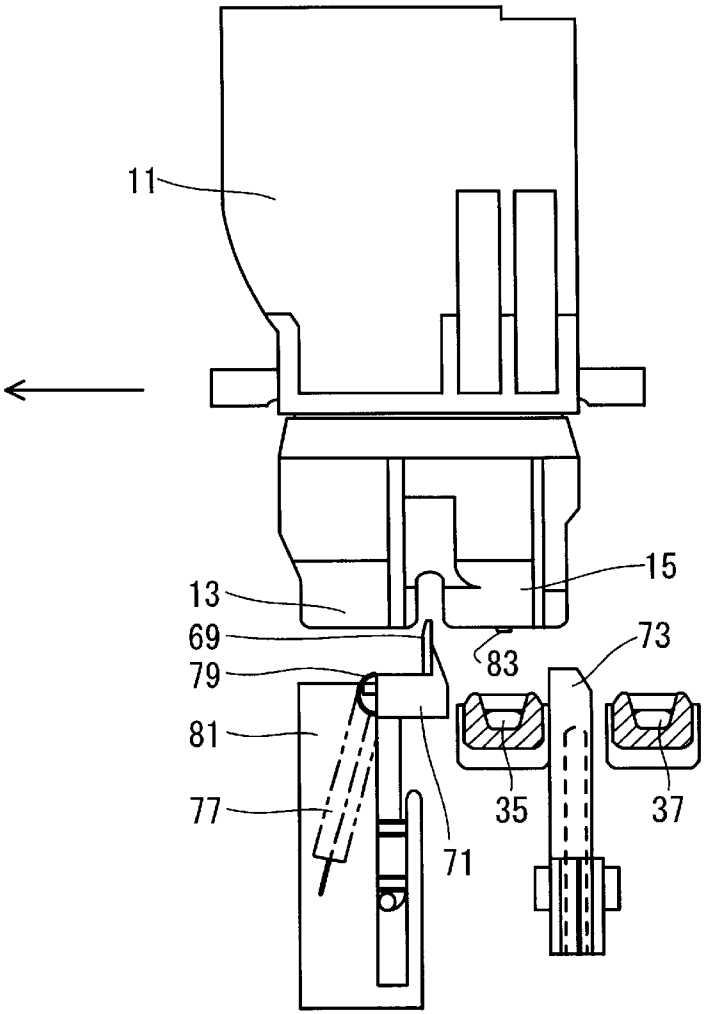
FIGS. 14A and 14B are front views of the carriage, the caps, the wiper blade, and the stopper of the portable printer, illustrating their movements when the purge operation for the right-side ink jet print head is performed.
Figure 14A:
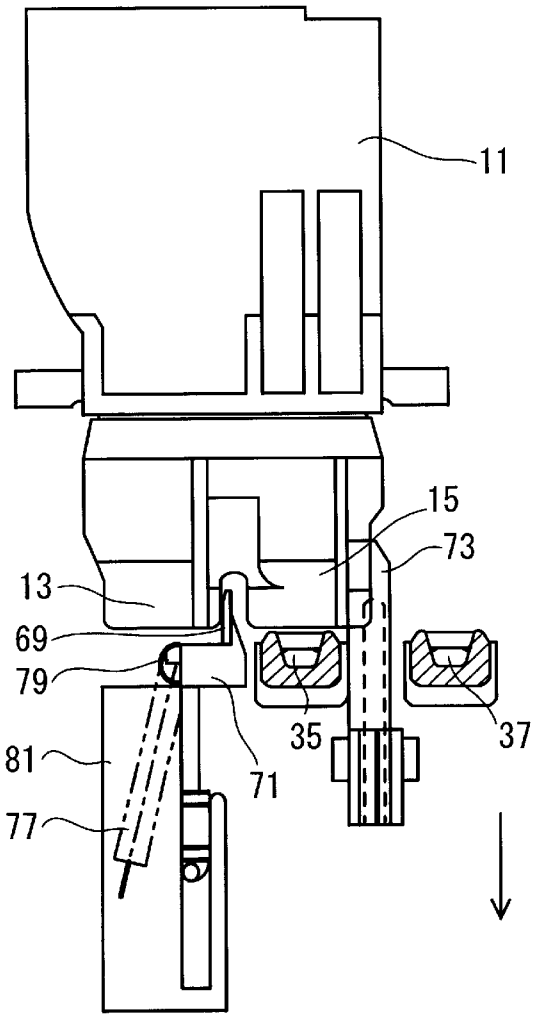

As shown in FIG. 14A, the ink ejecting surface of the right-side ink jet print head 15 is covered with the cap 35 when the caps 35, 37, the wiper blade 69, and the stopper 73 are at the most raised positions. In this state, the suction pump 51 sucks the ink from the right-side ink jet print head 15 as described above, thus the purge operation is performed for the right-side ink jet print head 15.

As the maintenance cam 41 starts to rotate after the purge operation, the caps 35, 37 and the stopper 73 are lowered to their initial positions, as shown in FIG. 14B. However, tiny protrusions 79 provided at the left side surface of the blade holder 71, contact and are received by the upper surface of a base 81 on the way that the wiper blade 69 is lowered, stopping the blade holder 71 from moving down. Therefore, the wiper blade 69 at this time is not lowered to the initial position but stays raised, as shown in FIG. 14B.

Figure 15B:
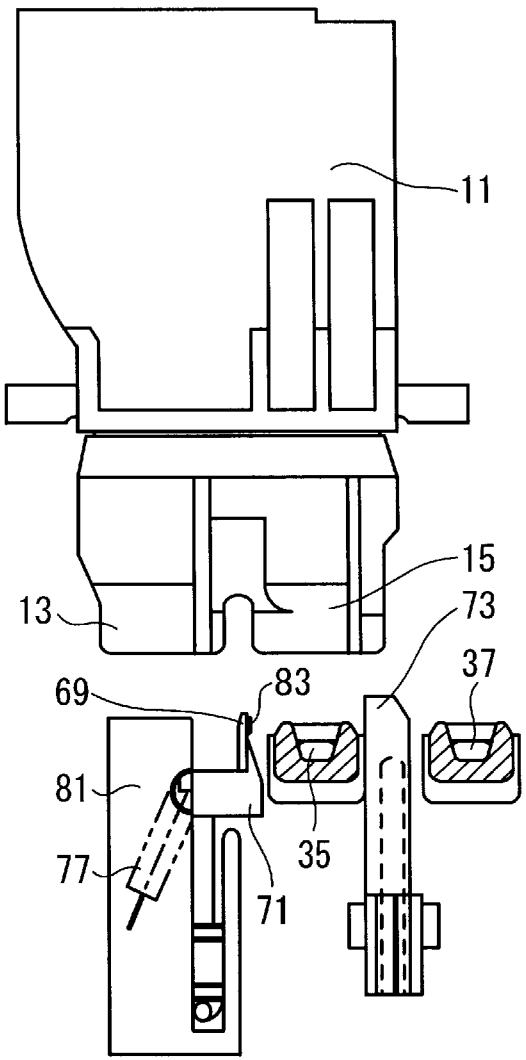
FIGS. 15A and 15B are front views of the carriage, the caps, the wiper blade, and the stopper of the portable printer, illustrating their movements when the purge operation for the right-side ink jet print head is performed.
Figure 15A:
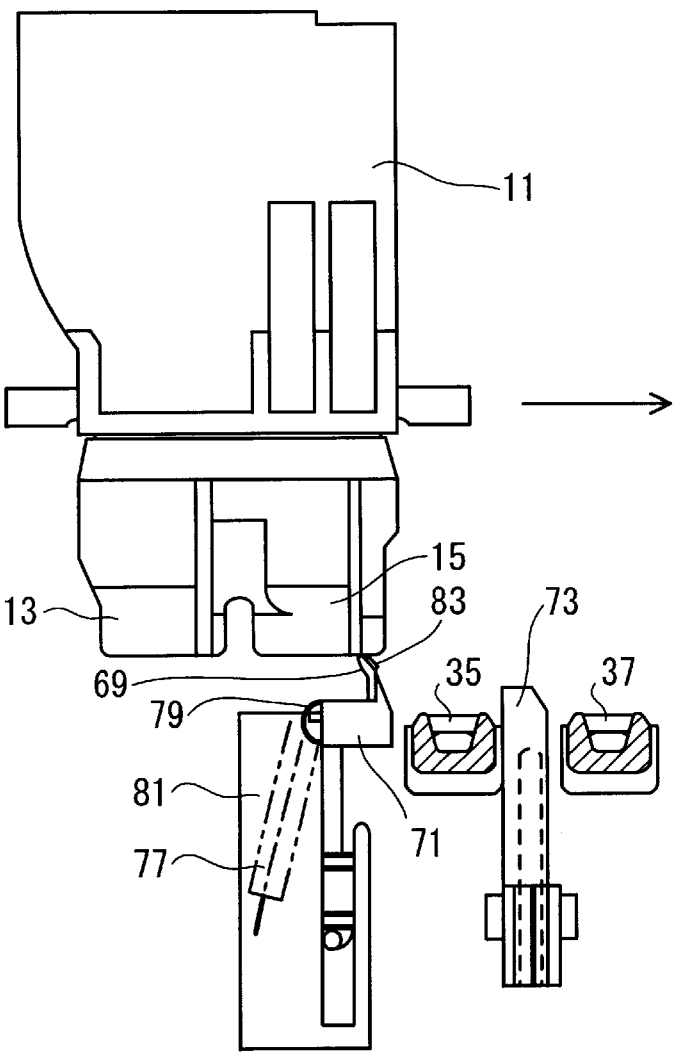

In this state, when the carriage 11 is moved to the left side, as shown by an arrow in FIG. 14B, the wiper blade 69 kept raised by the base 81, starts to wipe off the ink 83 remaining on the ink ejecting surface of the right-side ink jet print head 15 after purging. As shown in FIG. 15A, the carriage 11 is stopped after moving to the left side by the predetermined amounts before the wiper blade 69 reaches the edge of the ink ejecting surface of the right-side ink jet print head 15 and wipes off all the areas of the ink ejecting surface. The edge of the wiper blade 69 remains in contact with the ink ejecting surface of the right-side ink jet print head 15 with the wiper blade 69 kept bent or warped as the same as when the wiping operation is performed. The ink 83 wiped by the wiper blade 69 falls down on the bent or warped wiper blade 69, so that the ink 83 will not be scattered around in the printer.

Thereafter, as shown in FIG. 15A, the carriage 11 is moved to the right side. The blade holder 71 kept raised by the tiny protrusions 79 and the base 81, is pushed to the right side together with the wiper blade 69 by the right-side ink jet print head 15, and the tiny protrusions 79 are off from the base 81. At this time, the blade holder 71 is lowered and returned to the initial position as shown in FIG. 15B, since the blade holder 71 is pulled downwardly in a slanting direction by the coil spring 77.

As described above, in the portable printer 1 of this embodiment, as the maintenance cam 41 driven by the line feed motor 23 rotates, the wiper blade 69 is raised by the wiper raising arm 75 provided on the cap driving lever 67. The wiper blade 69 is kept raised with the coil spring 77, the tiny protrusions 79, and the base 81. As the carriage 11 is moved to the right side, the wiper blade 69 kept in the raised position is pushed to the right side and the tiny protrusions 79 are off from the base 81. The wiper blade 69 is pulled downwardly to the initial position by the tensile force of the coil spring 77. In above-described structure, any special drive sources for raising and lowering the wiper blade 69 are not required and its raising and lowering movements can be achieved by the simple structure.

In the portable printer 1 of this embodiment, for the wiping operation of the ink ejecting surface of the ink jet print heads 13, 15 after purging, the left-side movement of the carriage 11 is stopped before the wiper blade 69 reaches the edge of the ink ejecting surface of the ink jet print heads 13, 15 and wipes off all the areas of the ink ejecting surface. The ink 83 wiped by the wiper blade 69 falls down the blade bent or warped during the wiping operation and will not be scattered around in the printer by the wiper blade 69 sprung back due to its elasticity. Therefore, the inside the printer or the print sheet PP will not be soiled with the ink 83. Especially, since the ink jet print heads 13, 15 are positioned by the stopper 73 in this embodiment for the purge operation, the movement of the carriage 11 to the left side by the predetermined amounts before the wiper blade 69 reaches the edge of the ink ejecting surfaces of the ink jet print heads 13, 15 and wipes off the all the areas of the ink ejecting surface, is precisely regulated for the wiping operation by the wiper blade 69.

While the invention has been described with reference to the embodiment, it is to be understood that the invention is not restricted to the particular forms shown in the foregoing embodiment. Various modifications and alterations can be made thereto without departing from the scope of the invention.

As apparent from the foregoing description, in the ink jet printer of the invention, the wiper blade can be raised and lowered using a simple mechanism without the motor torque of the carriage motor increasing, and the ink wiped off the ink ejecting surface of the ink jet print head by the wiper blade, is not scattered around in the printer. Therefore, the inside the printer will not be soiled with ink.

Especially, the wiper blade can be raised to the ink wiping position by the drive force from the line feed (LF) motor and be lowered to the initial position by the drive force from the carriage (CR) motor. Therefore, by effectively using the motors provided for an ink jet printer, the raising and lowering mechanism of the wiper blade is simplified. Furthermore, since the different motors are used to raise the wiper blade to the ink wiping position and to lower it to the initial position, the wiper blade can be raised and lowered with the simpler mechanism and lower torque with respect to each LF and CR motor than the conventional ink jet printer using one motor for raising and lowering the wiper blade.

In the ink jet printer of the invention, the wiper blade can smoothly be lowered by the movement of the ink jet print head to the initial position after the wiping operation is finished with the edge of the wiper blade making contact with the ink ejecting surface.

Further, since the starting position where the ink jet print head starts to move for the ink wiping operation can be fixed due to the use of the stopper, the heads can be stopped at the precise position immediately before the wiper blade reaches the edge of the ink ejecting surfaces of the ink jet print head and wipes off the all the areas of the ink ejecting surface.

What is claimed is:

1. An ink jet printer, comprising:

a purge cap that covers an ink ejecting surface of an ink jet print head and sucks ink therefrom to perform purging;

a wiper blade that wipes the ink adhered to the ink ejecting surface purged by the purge cap;

a blade holder that holds the wiper blade, the blade holder having a tiny protrusion on a side opposite to a side facing to the purge cap;

an urging/pulling device that urges/pulls the blade holder in a direction that the tiny protrusion is provided and in a direction of an initial position where an edge of the wiper blade does not make contact with the ink ejecting surface;

a wiper moving member that moves the wiper blade to an ink wiping position where the wiper blade makes contact with the ink ejecting surface by engaging a portion of the blade holder according to the reciprocating movement between a first position where the purge cap stays closest to the ink ejecting surface and the purging is performed and a second position where the purge cap stays farthest away from the ink ejecting surface; and a base that receives the tiny protrusion of the blade holder against the urging force by the urging/pulling device so that the wiper blade is kept at the ink wiping position, wherein the blade holder is moved so that the edge of the wiper blade reaches the ink wiping position using a cap moving mechanism that moves the purge cap from the second position to the first position, and the wiper blade is returned to the second position by the urging/pulling device as the tiny protrusion is removed from the base by the ink jet print head being moved in a direction opposite to a direction that the ink is wiped by the wiper blade.

2. An ink jet printer, comprising:

a purge cap that covers an ink ejecting surface of an ink jet print head and sucking ink therefrom to perform purging;

a wiper blade that wipes the ink adhered to the ink ejecting surface purged by the purge cap;

a tiny protrusion provided on a side surface of a blade holder that holds the wiper blade and on an opposite side facing to the purge cap;

a pulling member that pulls the blade holder downwardly in a slanting direction that the tiny protrusion is provided;

a wiper raising member that raises the blade holder by contacting a lower surface of the blade holder according to an upward movement of the purge cap toward the ink jet print head; and a base that receives on the upper surface thereof, the tiny protrusion to stop the blade holder raised toward the ink jet print head by the wiper raising member at a raised position, the base receiving the tiny protrusion when the blade holder is lowered which stops the wiper blade at an ink wiping position.

3. The ink jet printer according to claim 2, wherein the purge cap and the wiper raising member are raised by a cam mechanism driven by a line feed motor for paper feeding.

4. An ink jet printer, comprising:

a purge cap for covering an ink ejecting surface of an ink jet print head and sucking ink therefrom to perform purging;

a wiper blade for wiping the ink adhered to the ink ejecting surface purged by the purge cap, the wiper blade being movable up and down between an upward ink wiping position and a downward initial position; and a relative movement mechanism that relatively moves the ink jet print head and the wiper blade in an ink wiping direction with the wiper blade raised to the ink wiping position and contacting to the ink ejecting surface, the relative movement mechanism stopping the relative movement in a first direction of the ink jet print head and the wiper blade across the ink jet print head immediately before the wiper blade reaches an edge of the ink ejecting surface after wiping off all areas of the ink ejecting surface and then lowering the wiper blade to an initial position by relative movement in a second direction opposite to the first direction.

5. The ink jet printer according to claim 4, further comprising:

a tiny protrusion provided on a side surface of a blade holder that holds the wiper blade and on an opposite side facing to the purge cap.

6. The ink jet printer according to claim 5, further comprising:

a pulling member that pulls the blade holder downwardly in a slanting direction that the tiny protrusion is provided.

7. The ink jet printer according to claim 6, further comprising:

a wiper raising/lowering member that raises or lowers the blade holder by contacting the lower surface of the blade holder according to the raising/lowering movement of the purge cap.

8. The ink jet printer according to claim 7, further comprising:

a base that receives on the upper surface thereof the tiny protrusion when the blade holder is lowered from the most raised position to stop the wiper blade at an ink wiping position.

9. The ink jet printer according to claim 8, further comprising:

a movement mechanism that lowers the purge cap after purging and moves the ink jet print head toward the wiper blade, the movement mechanism stopping the ink jet print head immediately before the wiper blade reaches an edge of the ink ejecting surface and wipes off all areas of the ink ejecting surface.

10. The ink jet printer according to claim 9, wherein the movement mechanism moves the ink jet print head in an opposite direction after the wiping operation is performed.

11. The ink jet printer according to claim 4, further comprising:

a stopper member that stops the ink jet print head right over the purge cap by contacting to the ink jet print head.

12. The ink jet printer according to claim 11, wherein the stopper member is raised and lowered together with the purge cap.

13. The ink jet printer according to claim 4, wherein the second direction is opposite to the first direction.

14. A method of operating an ink jet printer, comprising:

covering an ink ejecting surface of an ink jet print head with a purge cap;

purging ink from the ink jet head using the purge cap;

wiping the ink adhered to the ink ejecting surface purged by the purge cap using a wiper blade, the wiper blade being movable up and down between an upward ink wiping position and a downward initial position;

relatively moving the ink jet print head and the wiper blade in an ink wiping direction with the wiper blade raised to the ink wiping position and contacting to the ink ejecting surface;

stopping the relative movement in a first direction of the ink jet print head and the wiper blade across the ink jet print head immediately before the wiper blade reaches an edge of the ink ejecting surface after wiping off all areas of the ink ejecting surface; and lowering the wiper blade to an initial position by relative movement in a second direction opposite to the first direction.

15. The method according to claim 14, further comprising:

providing a tiny protrusion on a side surface of a blade holder that holds the wiper blade opposite to a side facing the purge cap.

16. The method according to claim 15, further comprising:

pulling the blade holder downwardly in a slanting direction that the tiny protrusion is provided.

17. The method according to claim 16, further comprising:

raising or lowering the blade holder by contacting the lower surface of the blade holder according to the raising/lowering movement of the purge cap.

18. The method according to claim 17, further comprising:

receiving on the upper surface thereof the tiny protrusion when the blade holder is lowered from the most raised position to stop the wiper blade at an ink wiping position.

19. The method according to claim 18, further comprising:

lowering the purge cap after purging; and moving the ink jet print head toward the wiper blade; and stopping the ink jet print head immediately before the wiper blade reaches an edge of the ink ejecting surface and wipes off all areas of the ink ejecting surface.

20. The method according to claim 19, wherein the moving step moves the ink jet print head in an opposite direction after the wiping operation is performed.

21. The method according to claim 14, further comprising:

stopping the ink jet print head right over the purge cap by contacting to the ink jet print head.

22. The method according to claim 21, wherein the stopping step is performed by a stopper member which is raise lowered together with the purge cap.

23. The ink jet printer according to claim 14, wherein the second direction is opposite to the first direction.

24. A wiping device, comprising:

a wiper blade that wipes the liquid adhered a liquid ejecting surface;

a blade holder that holds the wiper blade, the blade holder having a tiny protrusion on one side;

an urging/pulling device that urges/pulls the blade holder in a direction that the tiny protrusion is provided and in a direction of an initial position where the edge of the wiper blade does not make contact with the liquid ejecting surface;

a moving member that moves the wiper blade to a liquid wiping position where the wiper blade makes contact with the liquid ejecting surface; and a base that receives the tiny protrusion of the blade holder against the urging force by the urging/pulling device so that the wiper blade is kept at the liquid wiping position, the wiper blade being returned to an initial position by the urging/pulling device as the tiny protrusion is removed from the base by the liquid ejecting surface being moved in a direction opposite to a direction that the liquid is wiped by the wiper blade.

25. An ink jet printer, comprising:

a wiper blade for wiping an ink adhered to an ink ejecting surface of an ink jet print head, the wiper blade being movable up and down between an upward ink wiper position and a downward initial position; and a relative movement mechanism that relatively moves the ink jet print head and the wiper blade in an ink wiping direction with the wiper blade raised to the ink wiping position and contacting to the ink ejecting surface, the relative movement mechanism stopping the relative movement in a first direction of the ink jet print head and the wiper blade across the ink jet print head immediately before the wiper blade reaches an edge of the ink ejecting surface after wiping off all areas of the ink ejecting surface, wherein the wiper blade moves from the ink wiping position to the initial position while the wiper blade is in the state which is contact with the ink ejecting surface after stopping the relative movement.

26. The ink jet printer according to claim 25, wherein when the wiper blade reaches the edge of the ink ejecting surface after wiping off all areas of the ink ejecting surface, the relative movement mechanism moves the wiper blade to the initial position by a relative movement in a second direction.

27. The ink jet printer according to claim 26, wherein the second direction is opposite to the first direction.

28. An ink jet printer, comprising:

a cap that covers an ink ejecting surface of an ink jet print head;

a wiper blade for wiping the ink adhered to the ink ejecting surface;

a blade holder that holds the wiper blade and is movable between an ink wiping position where the wiper blade makes contact with the ink ejecting surface and an initial position where the wiper blade does not make contact with the ink ejecting surface, the blade holder having a tiny protrusion on a side opposite to a side facing to the cap;

an urging/pulling device that urges/pulls the blade holder in a direction that the tiny protrusion is provided and in a direction of the initial position;

a wiper moving member that moves the wiper blade to the ink wiping position by engaging a portion of the blade holder according to the reciprocating movement between a first position where the cap stays closest to the ink ejecting surface and a second position where the cap stays farthest away from the ink ejecting surface; and a base that receives the tiny protrusion of the blade holder against the urging force by the urging/pulling device so that the wiper blade is kept at the ink wiping position, wherein the blade holder is moved so that the edge of the wiper blade reaches the ink wiping position using a cap moving mechanism that moves the cap from the second position to the first position.

29. The ink jet printer according to claim 28, wherein the wiper blade is returned to the second position by the urging/pulling device as the tiny protrusion is removed from the base by the ink jet print head being moved in a direction opposite to a direction that the ink is wiped by the wiper blade.

30. An ink jet printer, comprising:

a wiper blade for wiping an ink adhered to an ink ejecting surface of an ink jet print head, the wiper blade being movable between an ink wiping position and an initial position;

a wiper moving member that moves the wiper blade between the ink wiping position and the initial position; and a relative movement mechanism that relatively moves the ink jet print head and the wiper blade in an ink wiping direction with the wiper blade moved to the ink wiping position and contacting the ink ejecting surface, wherein the wiper moving member moves the wiper from the ink wiping position, with the wiper blade contacting to the ink ejecting surface, to the initial position after the relative movement mechanism stops the relative movement immediately before the wiper blade reaches an edge of the ink ejecting surface after wiping off all areas of the ink ejecting surface.

* * * * *

UNITED STATES PATENT AND TRADEMARK OFFICE

CERTIFICATE OF CORRECTION

PATENT NO. : 6,371,595 B1 
DATED : April 16, 2002
INVENTOR(S) : Takatoshi Takemoto and Yoshiki Katayama It is certified that error appears in the above-identified patent and that said Letters Patent is hereby corrected as shown below:

Title page,
Item [30], Foreign Application Priority Data, change
"Sep. 19, 1998" to -- Sep. 28, 1998 -- for "(JP) ……. 10-274030"

Signed and Sealed this

Sixteenth Day of December, 2003

JAMES E. ROGAN
*Director of the United States Patent and Trademark Office*